US011022929B2

(12) United States Patent
Kawasumi

(10) Patent No.: US 11,022,929 B2
(45) Date of Patent: Jun. 1, 2021

(54) IMAGE FORMING APPARATUS HAVING GUIDE FOR AIRFLOW THROUGH FILTER

(71) Applicant: CANON KABUSHIKI KAISHA, Tokyo (JP)

(72) Inventor: Ryoichi Kawasumi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/804,965

(22) Filed: Feb. 28, 2020

(65) Prior Publication Data

US 2020/0201238 A1 Jun. 25, 2020

Related U.S. Application Data

(63) Continuation of application No. PCT/JP2018/032792, filed on Aug. 29, 2018.

(30) Foreign Application Priority Data

Aug. 29, 2017 (JP) ..... JP2017-164081

(51) Int. Cl.
*G03G 15/00* (2006.01)
*G03G 21/20* (2006.01)
*G03G 21/00* (2006.01)

(52) U.S. Cl.
CPC ..... *G03G 21/0052* (2013.01); *G03G 21/206* (2013.01); *G03G 2221/0094* (2013.01)

(58) Field of Classification Search
CPC ..... G03G 15/657; G03G 21/0052; G03G 21/206; G03G 2221/0094
See application file for complete search history.

(56) References Cited

U.S. PATENT DOCUMENTS

2007/0048001 A1* 3/2007 Yamada ..... G03G 15/657 399/99
2012/0177397 A1 7/2012 Pitas et al.
2014/0056608 A1* 2/2014 Miura ..... G03G 21/206 399/92
2015/0316891 A1* 11/2015 Satou ..... G03G 21/206 399/93
2018/0292782 A1* 10/2018 Nojima ..... G03G 21/206

FOREIGN PATENT DOCUMENTS

JP 07-114327 A 5/1995
JP 10-268716 A 10/1998
JP 2011-180340 A 9/2011
JP 2015-141341 A 8/2015
WO 2017/115877 A1 7/2017

OTHER PUBLICATIONS

International Search Report and Written Opinion dated Nov. 13, 2018, in International Patent Application No. PCT/JP2018/032792.
U.S. Appl. No. 16/805,221, Ryoichi Kawasumi, filed Feb. 28, 2020.
Office Action dated Mar. 30, 2021, in Japanese Patent Application No. 2019-539719.

* cited by examiner

*Primary Examiner* — Sophia S Chen
(74) *Attorney, Agent, or Firm* — Venable LLP

(57) ABSTRACT

In order to improve collecting efficiency of ultrafine particles (UFPs) by a filter in an image forming apparatus, a sheet feeding guide disposed between a transfer portion and a fixing portion is provided with an air passing portion in order to form an air passage toward the filter.

10 Claims, 8 Drawing Sheets

IMAGE FORMING APPARATUS HAVING GUIDE FOR AIRFLOW THROUGH FILTER

TECHNICAL FIELD

The present invention relates to an image forming apparatus, for forming a toner image on a sheet, such as a copying machine, a printer, a facsimile machine and a multi-function machine having a plurality of functions of these machines.

BACKGROUND ART

In the image forming apparatus of an electrophotographic type, it has been known that a parting agent (wax) contained in toner is heated and is temporarily put in a state of ultrafine particles (Ultra Fine Particles: having a particle size of 100 nm or less, hereinafter referred to as UFP or dust). In Japanese Laid-Open Patent Application (JP-A) 2011-180340, a proposal such that a filter is provided in a path along which the dust is discharged to an outside of the apparatus through a discharge (exhaust) duct and such dust is collected has been made.

SUMMARY OF THE INVENTION

Problem to be Solved by the Invention

An object of the present invention is to enhance dust collecting efficiency.

Means for Solving the Problem

According to an aspect of the present invention, there is provided an image forming apparatus comprising: an image forming portion for forming a toner image on a sheet in a first position by using toner containing a parting agent; a fixing portion for thermally fixing the toner image, in a second position, formed on the sheet by the image forming portion; a guiding portion for guiding the sheet from the first position toward the second position; a duct, including a suction port provided opposed to a sheet feeding path between the first position and the second position through the guiding portion, for discharging air to an outside of the image forming apparatus; and a filter, provided in the suction port of the duct, for collecting particles of a predetermined particle size resulting from the release agent, wherein the guiding portion is provided with an air passage for permitting air to flow from the sheet feeding path toward said suction port.

EMBODIMENTS FOR CARRYING OUT THE INVENTION

Figure 1:
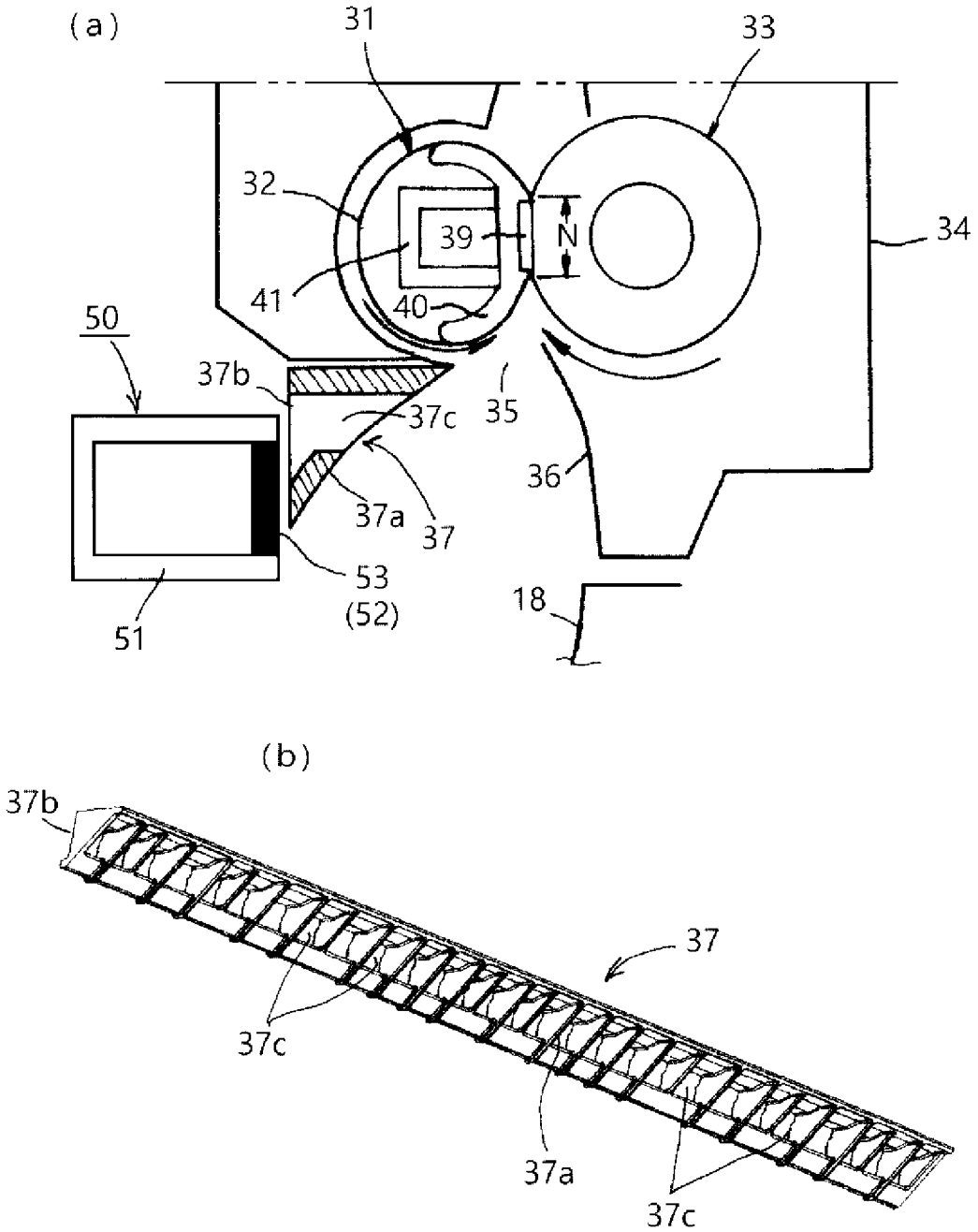
In FIG. 1, part (a) is an enlarged schematic cross-sectional view of a principal part of an image forming apparatus of an embodiment 1, and part (b) is a perspective view of a guiding member.

In the following, embodiments of the present invention will be described while making reference to the drawings. Members and portions common to respective figures are represented by the same reference numerals or symbols.

Embodiment 1

(Image Forming Apparatus)

Figure 2:
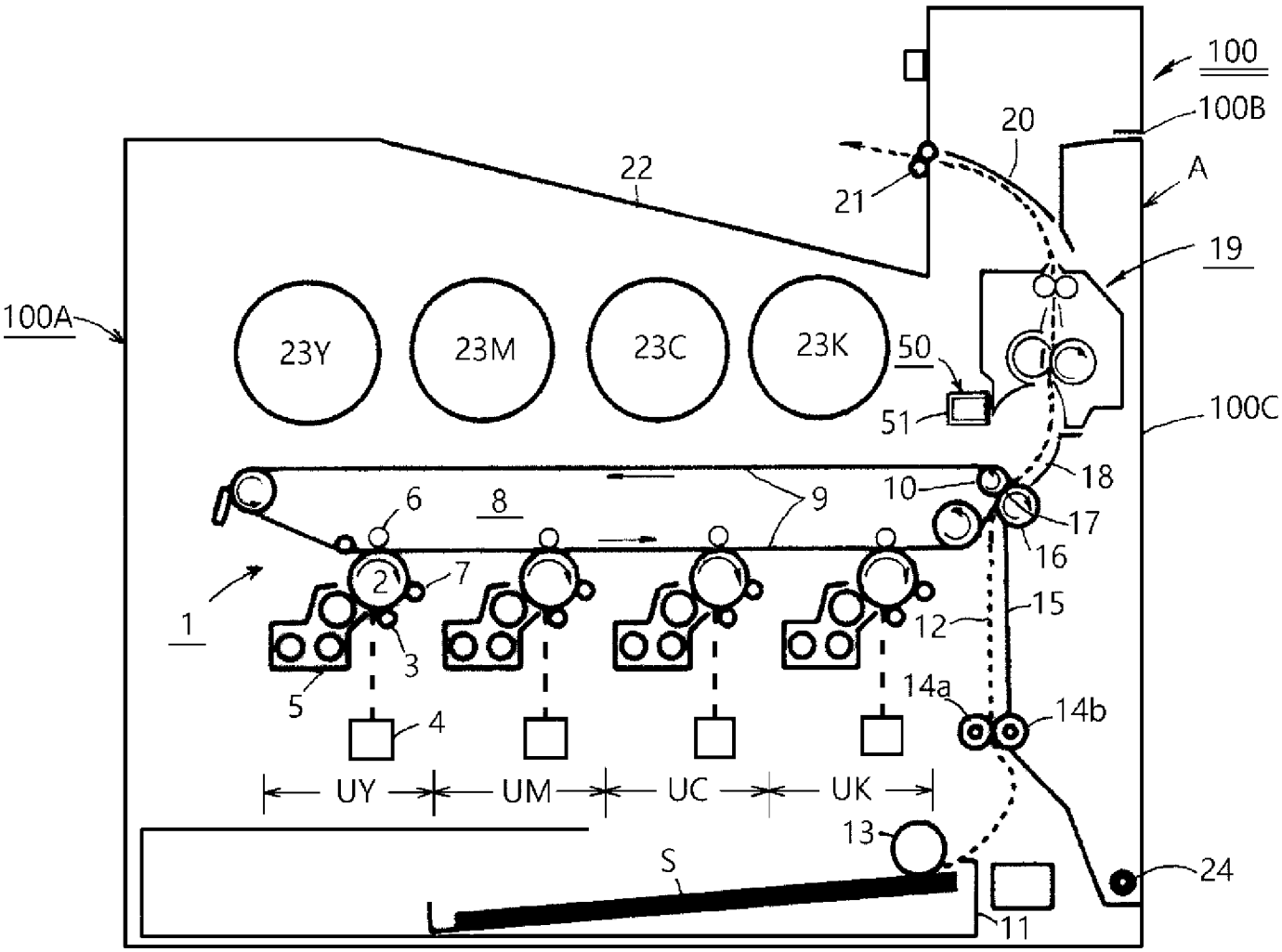
FIG. 2 is a schematic structural view of an example of an image forming apparatus.

FIG. 2 is a schematic longitudinal front view of an image forming apparatus 100 in this embodiment. In the following description, a front surface (front, front side) of the image forming apparatus 100 is a front side on the drawing sheet of FIG. 2, and a rear surface (rear, rear side) is a side opposite from the front side. Left and right is left and right when the apparatus 100 is seen from the front side (surface). Upper and lower are upper and lower with respect to a direction of gravitation. Upstream and downstream are upstream and downstream with respect to a sheet feeding direction.

This image forming apparatus is a four-color-based full-color laser printer of a tandem type-intermediary transfer type, and carries out toner image formation on a sheet on the basis of image information inputted from an external host device (not shown) such as a personal computer to a control circuit portion (not shown).

An image forming portion 1 in an inside of an image forming apparatus main assembly (apparatus frame: hereinafter referred to as an apparatus main assembly) 100A includes first to fourth (four) image forming units U (UY, UM, UC, UK). Further, the image forming portion 1 includes an intermediary transfer belt unit 8 and a sheet cassette 11 on an upper side and a lower side, respectively, of the first to fourth image forming units U.

The first to fourth image forming units U form toner images of four colors consisting of yellow (Y), magenta (M) and cyan (C) which are three primary colors of subtractive color mixture of back (K). Each image forming unit U includes a rotation drum-type electrophotographic photosensitive member (hereinafter referred to as a drum) 2 as an image bearing member. Further, the image forming unit U includes, as process means actable on the drum 2, a charging roller 3, a laser scanner (exposure device) 4, a developing device 5, a primary transfer roller 6 and a drum cleaner 7.

Incidentally, in order to avoid complication of the figure, representation of reference numerals for these devices in the image forming units UM, UC and UK other than the first image forming unit UY is omitted. Further, an electrophotographic image forming operation of the image forming portion 1 including these image forming units UY, UM, UC and UK and the intermediary transfer roller unit 8 is well known and therefore description thereof will not be provided.

The toner images of the respective colors described above are primary-transferred successively in a predetermined superposed manner from the drums 2 of the first to fourth image forming units U onto a rotating intermediary transfer belt (intermediary transfer member) 9. By this, superposed toner images of the four colors of Y+M+C+K are formed on the belt 9.

On a right side of the inside of the apparatus main assembly 100A, an upward feeding path 12 for feeding a sheet S from below toward above is provided. In this feeding path 12, in the order from a lower side to an upper side, a sheet feeding roller 13, a registration roller pair 14*a* and 14*b*, a secondary transfer roller 16, a fixing device (fixing apparatus) 19 and a (sheet) discharging roller 21 are provided. The secondary transfer roller 16 is contacted to the belt 9 toward a belt winding roller 10 with a predetermined urging force on a right side of the intermediary transfer belt unit 8 and forms a secondary transfer nip (portion) 17 in cooperation with the belt 9.

Reference numerals 15, 18 and 20 represent guiding members for guiding the sheet S in the feeding path 12. The guiding member 15 is provided between the registration roller pair 14*a* and 14*b* and the secondary transfer roller 16. The guiding member 18 is provided between the secondary transfer roller 16 and the fixing device 19. The guiding member 20 is provided between the fixing device 19 and the discharging roller 21.

The feeding roller 13 is driven at predetermined control timing, so that a single sheet S is separated and fed from the sheet cassette 11 and is guided into the feeding path 12. Then, the sheet S is guided into the secondary transfer nip 17 at predetermined control timing by the registration roller pair 14*a* and 14*b* and is nipped and fed. By this, the superposed four color toner images on the belt 9 are secondary-transferred and formed collectively onto the sheet S at the secondary transfer nip 17.

The sheet S coming out of the secondary transfer nip 17 is guided to the fixing device 19 functioning as a fixing portion and is subjected to a heat-fixing process of the toner images. The fixing device 19 is the fixing portion for fixing the toner images, formed on the sheet S at the secondary transfer nip (first position) 17 of the image forming portion 1, at a fixing nip (second position) N by heat and pressure. The sheet S coming out of the fixing device 19 is discharged as an image-formed product onto a (sheet) discharge tray 22 which is an upper surface portion of the apparatus main assembly 100A by the discharging roller pair 21.

Reference symbols 23Y, 23M, 23C and 23K represent toner bottles which accommodate replenishing toners to the developing devices 5 of the first to fourth image forming units UY, UM, UC and UK, respectively, and which are capable of exchange through mounting and demounting, and are provided above the intermediary transfer belt unit 8. Toner supply in an appropriate amount is timely made by a toner supplying mechanism (not shown) from the toner bottle corresponding to each of the developing devices 5 of the respective image forming units UY, UM, UC and UK.

(Fixing Device)

Figure 3:
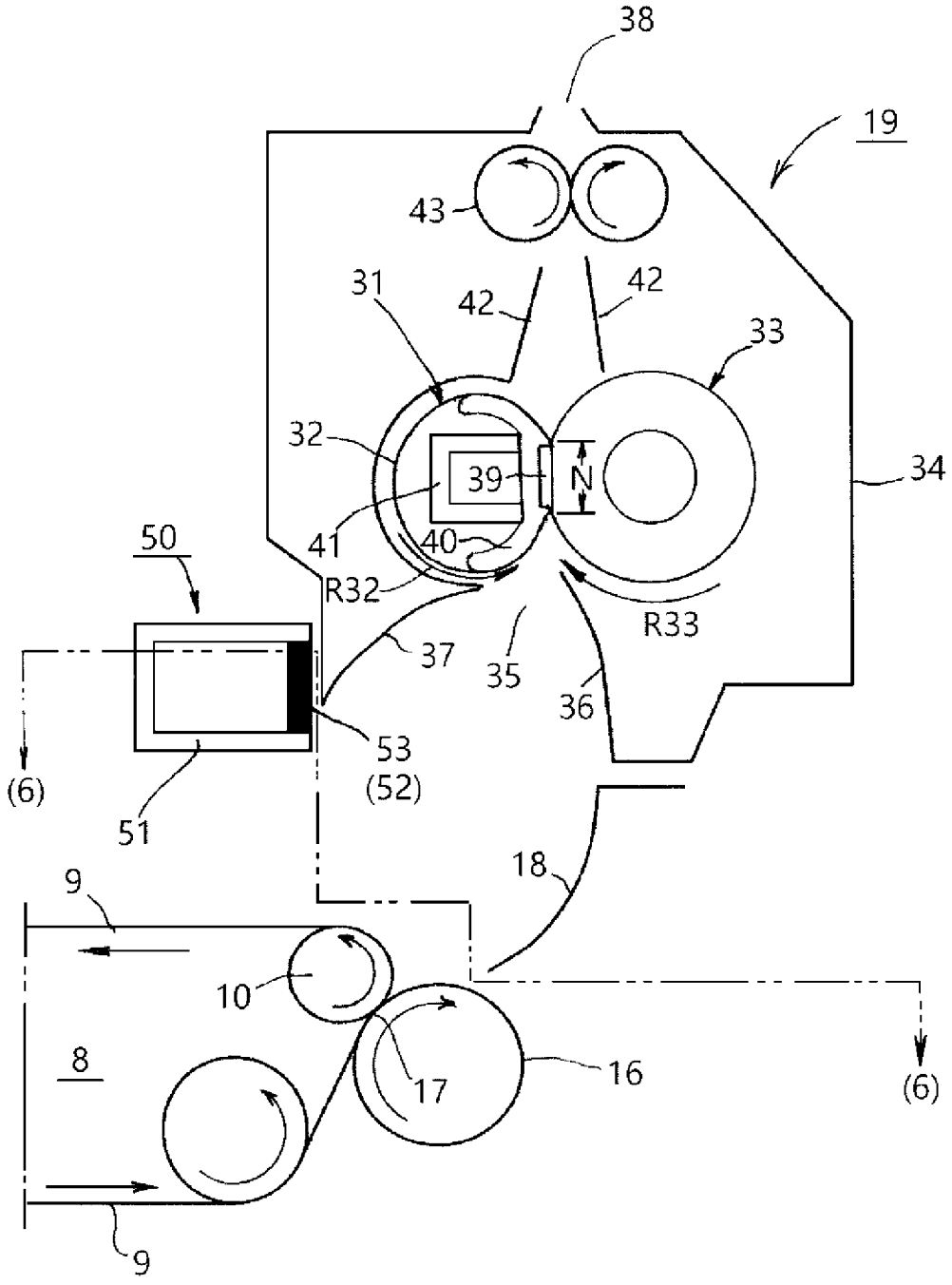
FIG. 3 is a partially enlarged schematic view of a principal part of FIG. 2.

FIG. 3 is a schematic enlarged view of a secondary transfer nip portion 17 and a fixing device 19 portion in FIG. 2. The fixing device 19 in this embodiment is an on-demand fixing device (ODF fixing device) of a belt heating type-pressing member driving type. A basis structure and a fixing operation of this fixing device are well known and therefore explanation thereof will be briefly made.

This fixing device 19 is roughly constituted by a belt unit 31 including a fixing belt (hereinafter referred to as a belt) 32 which is a first rotatable member, a pressing roller 33 which is a second rotatable member and which has elasticity, and a casing 34 accommodating these members. By the belt 32 and the pressing roller 33, the fixing nip N in which the sheet S carrying unfixed toner images is nipped and fed and in which the toner images are fixed by heat and pressure is formed.

The casing 34 is provided with a sheet entrance (sheet guiding port) 35 and a sheet exit (outlet) 38. The sheet entrance 35 is formed by a first guiding member 36 opposing a sheet back surface which is a non-toner image carrying surface of the sheet S and a second guiding member 37 opposing a sheet front surface which is a toner image carrying surface. The belt unit 31 and the pressing roller 33 are provided so that the sheet entrance 35 is positioned below the sheet exit 38 with respect to a direction of gravitation. The fixing device in this embodiment is constituted so as to feed the sheet S from below toward above with respect to the direction of gravitation, and this constitution is referred to as a vertical path structure.

In the belt unit 31, inside the belt 32, a fixing heater (heat source: hereinafter, referred to as a heater) 39, a heater holder (hereinafter, referred to as a holder) 40, a rigid stay (hereinafter, referred to as a stay) 41 and the like are provided.

The heater 39 is a heating source for heating the belt 32. Further, the heater 39 is an urging member for urging the belt 32 toward the pressing roller 33. As the heater 39, for example, a so-called ceramic heater is used. The heater 39 is disposed along a longitudinal direction (widthwise direction) of the belt 32. The heater 39 is disposed inside the belt 32 so as to be slidable on an inner surface of the belt 32.

The heater 39 generates heat by electric power supply from an energizing portion (not shown) and abruptly increases in temperature. A temperature of the heater 39 is detected by a temperature sensor (not shown) and is fed back to the control circuit portion (not shown). On the basis of detection temperature information inputted, the control circuit portion controls supply electric power from the energizing portion to the heater 39 so that the temperature of the heater 39 is increased to a predetermined target temperature and is (temperature-)controlled at the predetermined target temperature.

The holder 40 is a member for holding the heater 39 along the longitudinal direction thereof. The holder 40 fixes the heater 39 to the surface on the pressing roller 33 side. Further, the holder 40 is a guiding member for guiding a curvature shape of the belt 32 with respect to a circumferential direction so that the surface is easily separated from the belt 32. The holder 40 may desirably be excellent in heat-resistant property, and for example, a liquid crystal polymer can be used as the holder 40.

The stay 41 is a supporting member for supporting the holder 40 and the heater 39 along the longitudinal direction. The stay 41 is disposed on a side opposite from the pressing roller 33 while interposing the holder 40, the heater 39 and the belt 32 between itself and the pressing roller 33. The stay 41 is pressed toward the pressing roller 33 by a predetermined pressing force at opposite end to portions with respect to a longitudinal direction thereof.

By such a constitution, the stay 41, the holder 40 and the heater 39 press the belt 32 toward the pressing roller 33 side. The elastic rubber layer of the pressing roller 33 against which the belt 32 is pressed is elastically deformed and has a shape following a surface of the heater 39. Thus, the fixing nip N with a predetermined width with respect to a sheet feeding direction is formed between the belt 32 and the pressing roller 33.

The pressing roller 33 is disposed so that a rotational axis direction (longitudinal direction) thereof is substantially parallel to the longitudinal direction (generatrix direction) of the belt 32. The pressing roller 33 is rotatably held via bearings by front and rear side plates (not shown) of the casing 34 at opposite portions of the longitudinal direction of a core metal.

The core metal of the pressing roller 33 is connected to a driving mechanism (not shown) including a motor which is a driving source, and is rotationally driven clockwise at a predetermined peripheral speed in an arrow direction R33 by drive of the motor. To the belt 32 in a press-contact state with the rotationally driven pressing roller 33 in the fixing nip N, drive of the pressing roller 33 is transmitted by a frictional force in the fixing nip N, so that the belt 32 is rotated counterclockwise in an arrow R32 direction by the pressing roller 33.

In a state in which the pressing roller 33 is rotationally driven and the heater 39 is raised and (temperature-)controlled to a predetermined target temperature, the sheet S on which the unfixed toner images are formed in the secondary transfer portion (first position) 17 of the image forming portion 1 is fed to the fixing device 19. Then, the sheet S enters the fixing device 19 through a sheet entrance 35 and is nipped and fed in the fixing nip (second position) N.

In this embodiment, the fixing device 19 is positioned above the intermediary transfer belt 9 with respect to a direction of gravitation, so that the fixing nip N is positioned above the secondary transfer nip 17 with respect to the direction of gravitation. Accordingly, the sheet S coming out of the secondary transfer nip 17 is fed upward and is guided from below to above with respect to the fixing device 19. The guiding members 18, 36 and 37 for feeding the sheet S from the secondary transfer nip 17 to the fixing nip N are formed by an inclined surface or a curved surface and are provided so as to be capable of guiding the sheet S to the fixing nip N with reliability.

To the sheet S, heat of the heater 39 is imparted via the belt 32 in a process in which the sheet S is nipped and fed through the fixing nip N. The unfixed toner images are melted by heat of the heater 39 and are fixed by pressure applied to the fixing nip N. Then, the sheet S nipped and fed in the fixing nip N passes through a guiding member 42 and an inner fixing discharging roller pair 43 and comes out of the fixing device 19 through a sheet exit 38. Further, the sheet S passes through a guiding member 20 and is sent to the discharge tray 22 by the discharge roller pair 21.

(Openable Door)

In the image forming apparatus 100 of the present invention, a right-side surface of the apparatus main assembly 100A is provided with an opening 100B as an access port during clearance of a jammed sheet and maintenance of an inside of the apparatus, and the like. Further, an openable door 100C movable between a predetermined closed position A (FIG. 2) where this opening 100B is closed and a predetermined open position B (FIG. 4) where the opening 100B is open is provided. In this embodiment, the openable door 100C is openable and rotatable about a lower hinge shaft 24 as a rotation center.

The openable door 100C is open-stopped and held by a locking operation of a locking mechanism (not shown) when the openable door 100C is sufficiently closed to the closed position A relative to the apparatus main assembly 100A as shown in FIG. 2. The image forming apparatus 100 is capable of performing an image forming operation in a state in which the openable door 100C is closed.

Figure 4:
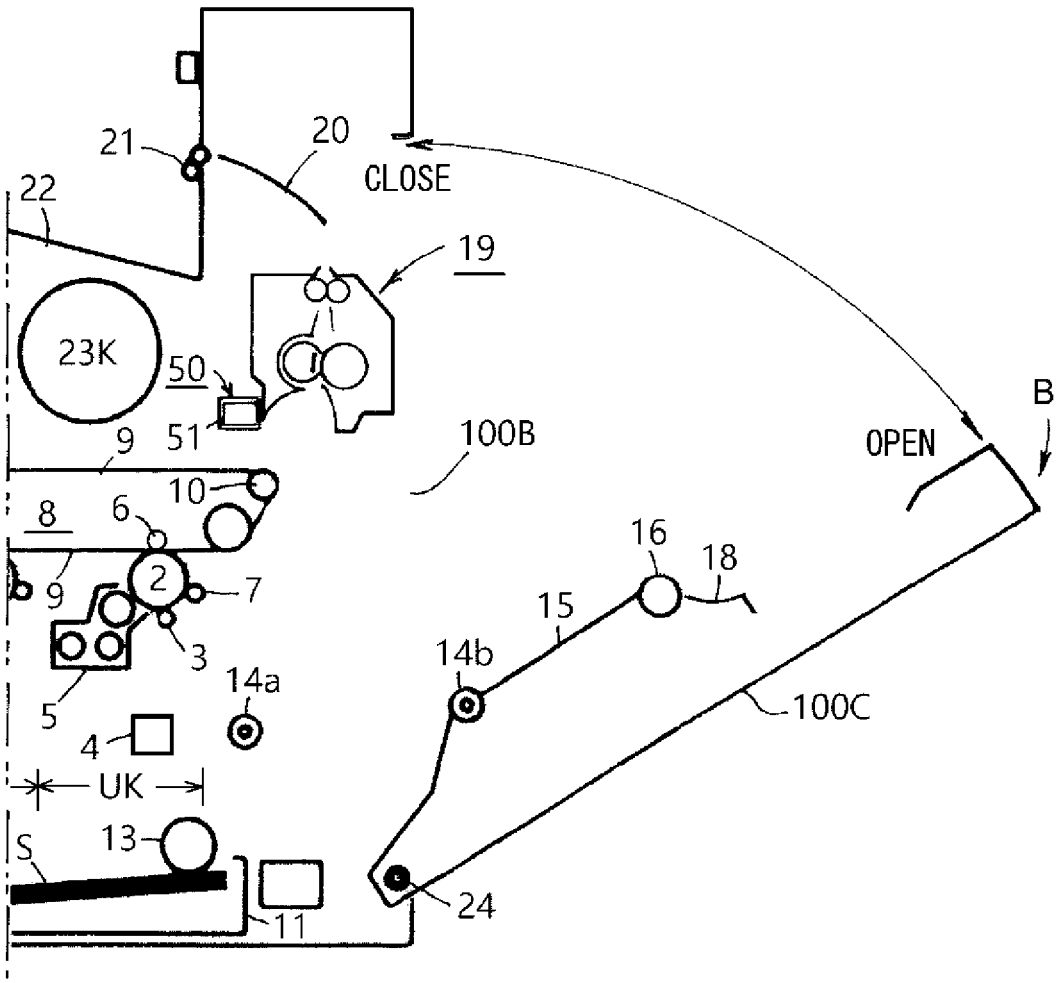
FIG. 4 is a view showing a state in which an openable door is opened.

The openable door 100C can be sufficiently rotated from the closed position A of FIG. 2 to the open position B as shown in FIG. 4 by lock release of the locking mechanism. Inside the openable door 100C, the one roller 14*b* of the registration roller pair 14*a* and 14*b*, the guiding member 15, the secondary transfer roller 16 and the guiding member 18 which are disposed in the upward feeding path 12 along which the sheet S is fed from below toward above are provided. Accordingly, the feeding path 12 is largely opened at the opening 100B on a right side of the apparatus main assembly 100A by opening the openable door 100C.

Figure 5:
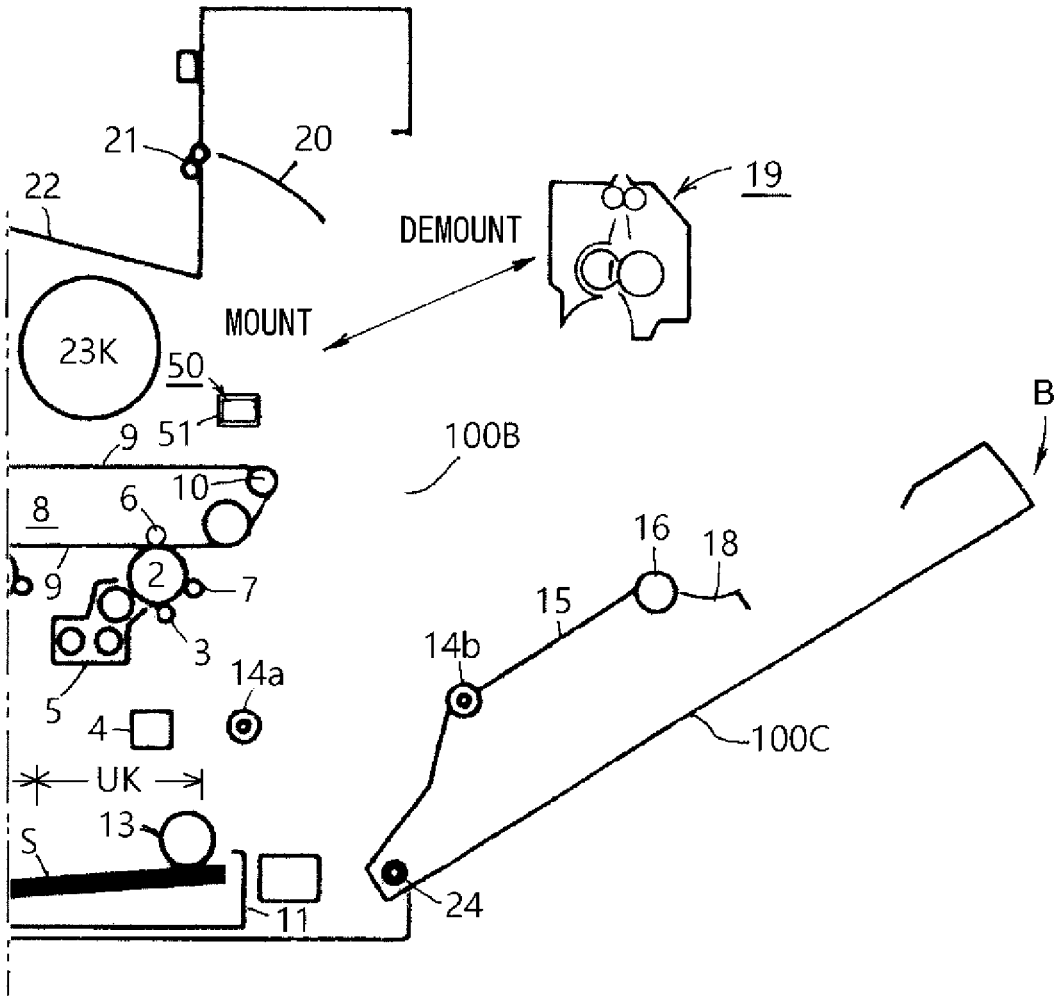
FIG. 5 is an illustration of mounting and demounting of a fixing device.

By this, removal of the sheet jammed in the feeding path 12 including the fixing device 19 (jam clearance) can be easily performed. Further, a constitution in which maintenance of the intermediary transfer belt 9 and the fixing device 19 and the like can also be easily performed is employed. In the image forming apparatus 1 of this embodiment, the fixing device 19 is provided so as to be mountable and demountable in a screw-less manner by a hooking structure or the like onto a predetermined mounting portion (not shown) in an inside of the apparatus main assembly 100A. Accordingly, a constitution in which mounting and demounting of the fixing device 19 relative to the mounting portion of the apparatus main assembly 100A can be easily performed in the screw-less manner by having access to the inside of the apparatus through the opening 100B opened by opening the openable door 100C as shown in FIG. 5 is employed.

(Mechanism of UFP Generation)

A mechanism or manner of generation of UFP (dust) due to the parting agent of the toner will be described. The fixing device 19 fixes the toner image by bringing the belt 32 which is a high-temperature fixing member into contact with the sheet S. In the case where the fixing process is performed by using such a constitution, a part of the toner is transferred (deposited) on the belt 32 during the fixing process in some instances. This is called an offset phenomenon, but the offset phenomenon causes an image defect, and therefore, measures against the offset phenomenon are required to be taken.

Therefore, in general, in the toner used in the image forming apparatus, a wax as the parting agent is incorporated. From this toner, the inner wax is melted and bleeds when the toner is heated, and therefore, when this toner image is subjected to the fixing process, the surface of the belt 32 is covered (coated) with the melted wax. The belt 32 of which surface is covered with the wax has an effect that the toner is not readily deposited on the belt surface by the parting (releasing) function of the wax.

Incidentally, in this embodiment, in addition to pure wax, a compound including a molecular structure of the wax is also called the wax. For example, a compound obtained by reaction of a toner resin molecule with a wax molecular structure such as a hydrocarbon chain is also called the wax. Further, as the parting agent, other than the wax, a substance having the parting function, such as silicone oil may also be used.

When the wax is melted, a part thereof is vaporized (volatilized). This would be considered to occur because there is a variation in size of a molecular component contained in the wax. That is, it is considered that in the wax, a low molecular component which is short in molecular chain and which is low in being boiling point and a high molecular (polymer) component which is long in molecular chain and which is high in boiling point are contained and the low molecular component low in boiling point is vaporized early. When the vaporized (gasified) wax component is cooled in the air, fine particles of a predetermined particle size (several nm to several hundreds of nm) generate (it is predicted that most of the fine particles have the particle size of several nm to several tens of nm). Specifically, the wax is fine particles of 5.6 nm or more and 560 nm or less in particle size. That is, the fine particles are the UFP described above.

The UFP generate by the above-described mechanism, and therefore, it is understood that the UFP most generate from the fixing nip N in which the heat is applied to the wax. Further, a side where the temperature of the belt 32 is highest is an upstream side of the fixing nip N due to rotation of the belt 32 and arrangement of the heater 39 and the like, and therefore, it can be predicted that a degree of the generation of the UFP is also maximum on the upstream side of the fixing nip N. Further, the UFP generate from the toner image transferred on the sheet S, and therefore, it is also understood that the UFP generate from an entire region of an image region of the fixing nip N.

(UFP Reducing Structure)

Next, a structure for reducing the UFP will be described. For reducing the UFP which are the fine particles of 5.6 nm or more and 560 nm or less in particle size, as described above, the generated UFP are collected by using a filter provided inside the apparatus main assembly and air suction. For that reason, it becomes possible to reduce an amount of the UFP discharged to the outside of the apparatus.

Here, as regards the arrangement of the filter, the filter is disposed in the neighborhood of the image region on the upstream side of the fixing nip N which is a maximum generation position of the UFP. Further, it is self-evident from the mechanism of the UFP generation described above in detail that when the air suction can be uniformly performed in the entire region of the filter with respect to the longitudinal direction, the UFP would be able to be collected most efficiently.

Figure 6:
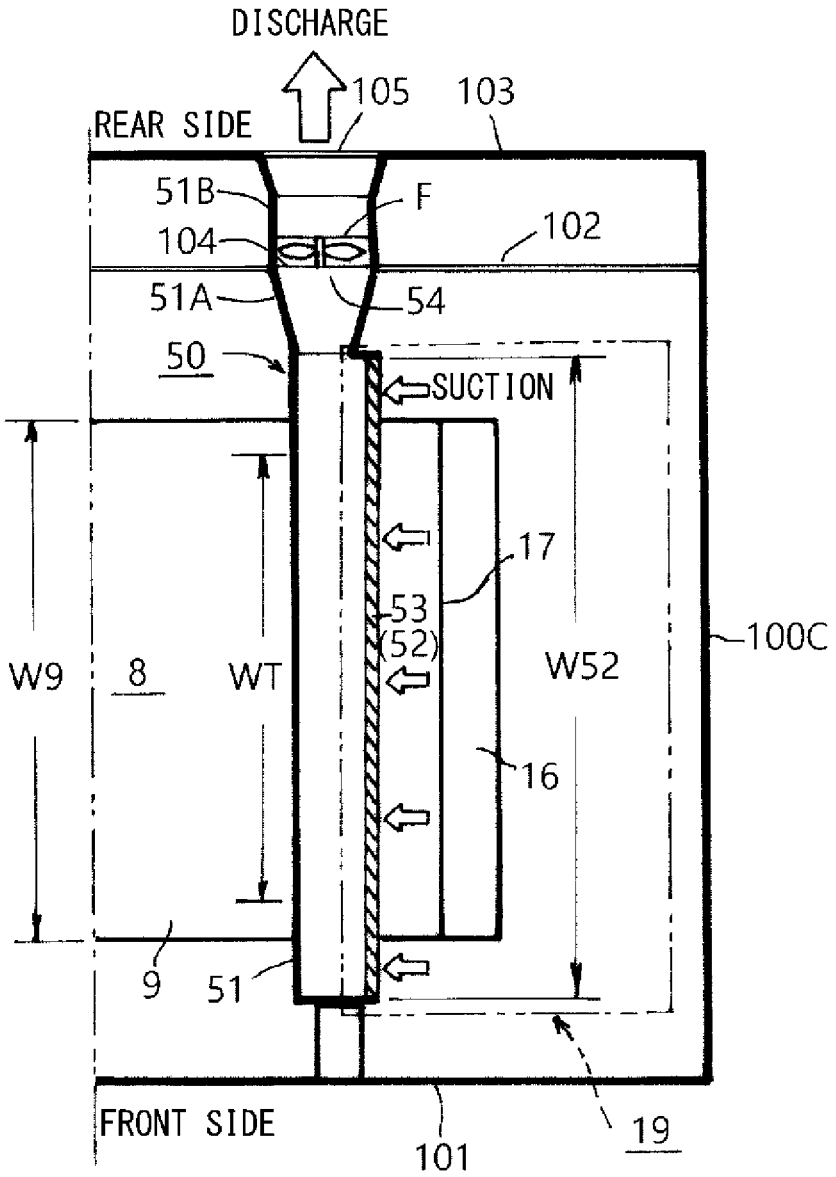
FIG. 6 is a schematic view seen in an arrow direction of (6)-(6) line in FIG. 3.

In the figures, a reference numeral 50 represents a duct unit as an UFP reducing structure in the image forming apparatus 100 of this embodiment. FIG. 6 is a schematic view seen in an arrow direction of (6)-(6) line in FIG. 3. The duct unit 50 is positioned between the secondary transfer portion (first position) 17 of the image forming portion 1 and the fixing nip (second position) N of the fixing portion 19. The duct unit 50 includes a suction port 52, a filter 53 for collecting (filtering) the UFP (particles resulting from the parting agent (wax)), and a duct 51 including a (air) discharge port 54 permitting discharge of the air to the outside of the apparatus.

The duct 51 in this embodiment is a hollow member which is long along the longitudinal direction of the fixing device 19 and which is substantially rectangular in cross-section. The suction port 52 extends along the longitudinal direction of the fixing nip N. The filter 53 is provided on this suction port 52 while covering the suction port. That is, the filter 53 is a flat surface member formed so that a longitudinal direction thereof extends in a direction perpendicular to the sheet feeding direction and is fixed to the suction port 52.

One end portion (front end portion) of the duct 51 is closed, and the other end portion (rear end portion) is increased in diameter as a bell mouse-shaped duct portion 51A and is opened as the discharge port 54.

In the image forming apparatus 100 of this embodiment, as a rear (surface) plate of the apparatus main assembly 100A, as shown in FIG. 6, a first rear plate 102 and a second rear plate 103 provided with a predetermined interval therefrom are provided. The first rear plate 102 and the second rear plate 103 are provided with a first opening 104 and a second opening 105, respectively, opposing each other. Further, the first opening 104 and the second opening 105 are connected by a fan duct 51B in which a fan F is incorporated.

The duct 51 is disposed by being supported by a supporting member (not shown) in an inside of the apparatus main assembly 100A at a predetermined mounting position between a front(-side) plate 101 and the first rear plate 102 so that the front end portion is on the front(-side) plate 101 side and the rear end portion is on the first rear plate 102 side and so that the duct unit 50 is mountable in and demountable from the apparatus main assembly 100A. In a state in which the duct unit 50 is mounted in the apparatus main assembly 100A in a predetermined manner, the discharge port 54 of the rear end portion of the duct 51 correspondingly coincides with the first opening 104 provided in the first rear plate 102.

That is, the discharge port 54 of the duct 50 communicates with the outside on the rear side of the apparatus main assembly 100A via the first opening 104, the fan duct 51B and the second opening 105. The fan F is controlled by the control circuit portion (not shown). The fan F is driven, the air flow generates in the duct 51 and the air in the duct 51 is discharged to the outside of the apparatus through the discharge port 54 along the above-described path. By this, the air is sucked in the duct 51 through the suction port 52 covered with the filter 53.

The duct 51 is disposed on a side (a side of the first rotatable member 32 provided with the heat source 39) of the belt unit 31 of the fixing device 16 between the secondary transfer portion 17 and the fixing nip N. Further, the suction port 52 of the duct 51 covered with the filter 53 is positioned further on the fixing nip N side than an intermediary portion between the secondary transfer portion 17 and the fixing nip N is, and further is positioned in the neighborhood of the fixing nip N. That is, the suction port 52 covered with the filter 53 is disposed in the neighborhood of the upstream side of the fixing nip N and is disposed on the rear side of the guiding member 37.

The duct unit 50 having the above-described structure sucks the air containing the UFP, existing between the secondary transfer portion 17 and the fixing nip N, in the duct 51 through the suction port 52 covered with the filter 53 while filtering the UFP with the filter 53. Further, a constitution in which the air from which the UFP are filtered by the filter 53 is discharged along a path of the discharge port 54, the first opening 104, the fan duct 51B and the second opening 105 is employed. That is, the UFP discharged to the outside of the apparatus by this duct unit 50 decreases.

The suction port 52 has a certain length with respect to a direction perpendicular to the sheet feeding direction as shown in FIG. 6. By this, a constitution in which the UFP generated from the wax transferred from the toner image on the sheet S onto the belt 32 can be collected with reliability with respect to the longitudinal direction (widthwise direction). In FIG. 6, W52 is a length of the suction port 52 with respect to the longitudinal direction, and WT is a width (maximum image width) of an image formable region on the sheet. W9 is a width of the intermediary transfer belt 9. The length W52 of the suction port 52 is set so as to exceed the maximum image width WT.

Incidentally, in the case where the image forming apparatus is capable of utilizing the sheets S having a plurality of large and small width sizes, with respect to the width size highest in use frequency, the width sizes may only be required to be set to satisfy W52>WT. In the case where the use frequency of the sheet S having a smallest width size is high, on the basis of a maximum image width T of the smallest width size-sheet, the length W52 of the suction port 52 with respect to the longitudinal direction can be set so as to satisfy W52>WT. That is, the length W52 of the suction port 52 is a length of the maximum image width WT of the minimum width size-sheet usable in the apparatus.

Further, in the case where the use frequency of the sheet S having a largest width size is high, on the basis of the maximum image width WT of the largest width size-sheet, the length W52 of the suction port 52 with respect to the longitudinal direction can be set so as to satisfy W52>WT. That is, the length W52 of the suction port 52 is a length of the maximum image width WT of the maximum width size-sheet usable in the apparatus.

Further, the suction port 52 is, as shown in FIG. 3, not only disposed in the neighborhood of the belt 32 but also is in a position opposing the sheet S which will enter the fixing device 19. By such arrangement, the duct unit 50 can be downsized. That is, the suction port 52 is in the neighborhood of the belt 32 which is a dust generation portion, and simultaneously, is disposed at the position opposing the sheet S. By this, the duct unit 50 can omit the path along which the air is guided from the fixing nip N to the suction port 52, so that entirety of the apparatus is easily downsized.

The fan F for sucking the air in the duct 51 is fixed in a shortest path via the duct 51 at the end portion. By this, it is first understood that arrangement of the filter 53, the duct 51 and the fan F has a shortest path.

Further, the filter 53 is disposed by being extended in the longitudinal direction of the suction port 52 of the duct 51, and therefore, pressure loss on the upstream side through the filter 53 and pressure loss on the downstream side through the filter 53 are substantially the same with respect to the longitudinal direction, and an air sucking force through the suction port 52 is also substantially the same between the front side and the rear side. That is, an air flow distribution along the longitudinal direction of the suction port of the air sucked through the suction port 52 is substantially uniform.

Accordingly, by employing the above-described arrangement of the filter 53, the duct 51 and the fan F, the air can be substantially uniformly sucked through the filter 53 from an entire image region of the fixing nip N.

Consequently, it is understood that the UFP generated from the entire image region of the fixing nip N can be collected substantially uniformly.

Further, an air sucking force can also be lowered by optimizing the air suction by the above-described arrangement, so that cost reduction and downsizing of the fan F can also be realized.

From the above, by employing cross-sectional arrangement shown in FIG. 2, FIG. 3 and FIG. 6, the UFP reducing structure can be arranged at a low cost and with space saving and high efficiency.

(Structure of Guiding Member 37)

Incidentally, by removing the guiding member 37, the duct 51 of the duct unit 50 and the filter 53 can be disposed closer to the fixing nip N. However, in that case, in the case where the sheet S to be fed from the secondary transfer portion 17 to the fixing device 19 is violently fed on the filter 53 side, there is a liability of an occurrence of a trouble on sheet feeding such that the sheet S does not enter the fixing nip N. Further, in addition, by the violent feeding of the sheet S, the toner in a small amount scatters from the unfixed toner image formed on the sheet and is gradually deposited on the surface of the filter 53, so that there is a liability of an occurrence of a trouble such that the toner collecting power of the filter 53 gradually decreases.

By this, it can be said that a constitution of FIG. 3 in which the guiding member 37 is disposed in the neighborhood of the fixing nip N and the filter 53 is disposed on a rear (back) surface side thereof is optimum also from the viewpoints of a feeding property of the sheet S and filter performance retention. That is, the guiding member 37 in this embodiment does not contact the sheet S if the feeding state of the sheet S is normal and is capable of contacting the (surface (image surface) of the) sheet S if the feeding state of the sheet is abnormal. Thus, even when the guiding member has the function capable of performing its function only during abnormal feeding, in this embodiment, the guiding member is called the "guiding member (guiding portion)" for guiding the (feeding of the) sheet S.

The filter 53 is disposed on the rear surface of the guiding member 37 as shown in FIG. 3. The reason and ground therefor are as described above. However, as shown in FIG. 3, if the guiding member 37 is integral with the fixing device 19 and has a cross-section with no void at all on its surface, the guiding member 37 constitutes a "partition", so that there is a liability that the UFP collecting efficiency largely lowers. That is because collection of the UFP is made by the air passing through the filter 53 and when the surface of the filter is blocked, a flow of the air at the blocked portion stagnates. That is, it can be said that it is problematic that the shape of the guiding member 37 has the influence on the UFP collecting efficiency.

Therefore, in this embodiment, the above-described problem is solved by a guiding member structure as in FIG. 1. Part (a) of FIG. 1 is a schematic enlarged cross-sectional view of a principal part, and part (b) of FIG. 1 is a perspective view of an outer appearance of the guiding member 37.

The guiding member 37 in this embodiment 1 is a mold product of a heat-resistant resin (material) and is integrally fixed to a predetermined portion of the casing 34 of the fixing device 19. The guiding member 37 has a first surface (feeding surface for feeding the sheet) 37*a* for guiding the sheet S. Further, the guiding member 37 has a second surface (rear (back) surface) 37*b* on a side opposite from this first surface 37*a*. Further, the guiding member 37 is provided with an air passing portion (void) 37*c* functioning as an air passage (portion) for permitting air to flow (passing-through of the air) from a first surface side to a second surface side.

The air passing portion 37*c* is a through hole from the first surface side to the second surface side, and with respect to the longitudinal direction of the guiding member 37, as shown in the perspective view of part (b) of FIG. 1, a plurality of through holes are successively disposed. That is, the guiding member 37 is disposed along the longitudinal direction of the fixing nip N, and the air passing portion 37*c* is a plurality of openings successively disposed along the longitudinal direction of the guiding member 37. The air passing portion 37*c* is open at a ratio of 50% or more to an entire area of the first surface 37*a* of the guiding member 37. That is, the air passing portion 37*c* has a region of 50% or more at the first surface 37*a*.

Further, the duct 51 of the duct unit 50 is disposed on the second surface 37*b* side of the guiding member 37, and the suction port 52 covered with the filter 53 of the duct 51 is disposed substantially opposed to the second surface 37*b* of the guiding member 37. Thus, the duct unit 50 is capable of sucking, in the duct 51, the air which has passed through the air passing portion 37*c* of the guiding member 37 by drive of the fan and which contains the UFP between the secondary transfer portion 17 and the fixing nip N, while filtering the air through the suction port 52.

Thus, a flow of the air passing through the filter 53 is caused to pass through the air passing portion 37*c* of the guiding member 37, so that an effect of guiding the sheet S is obtained without lowering the UFP collecting efficiency. Further, at the same time, an effect such that a scattering toner is not readily deposited on the filter 53 is also obtained.

Embodiment 2

Figure 7:
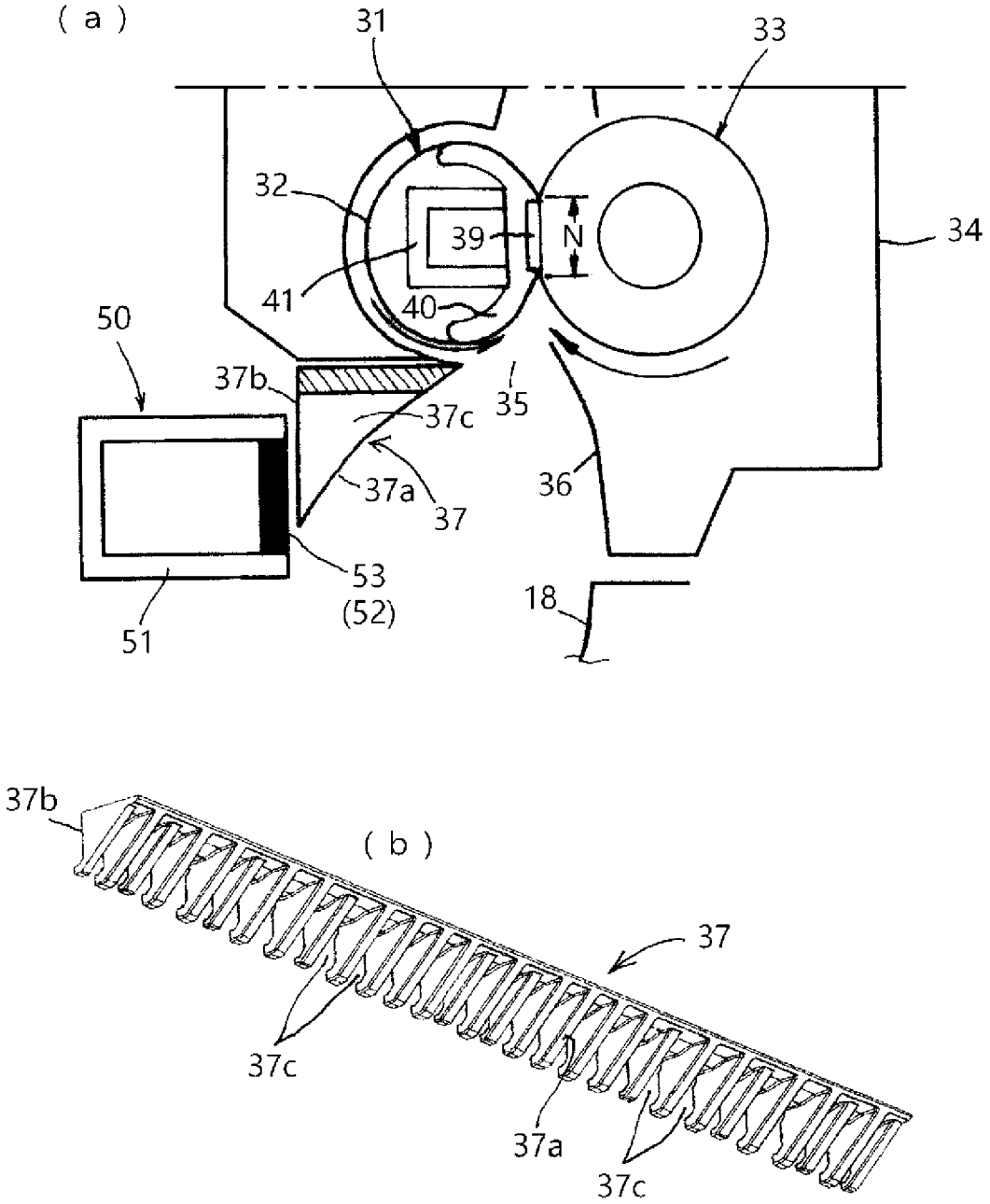
In FIG. 7, part (a) is an enlarged schematic cross-sectional view of a principal part of an image forming apparatus of an embodiment 2, and part (b) is a perspective view of a guiding member.

FIG. 7 includes illustrations of this embodiment 2, and part (a) is a schematic enlarged cross-sectional view of a principal part, and part (b) is a perspective view of an outer appearance of the guiding member 37. The guiding member 37 in this embodiment is also a mold product of a heat-resistant resin and is fixed integrally with a predetermined portion of the casing 34 of the fixing device 19. Further, the guiding member 37 has a first surface (a feeding surface for feeding the sheet) 37*a*. Further, the guiding member 37 has a second surface (rear surface) 37*b* on a side opposite from the first surface 37*a*. Further, the guiding member 37 is provided with an air passing portion (void) 37*c* functioning as an air passage for permitting air to flow from the first surface side to the second surface side.

The guiding member 37 in this embodiment 2 is provided with a slit as the air passing portion 37*c* from a guide central portion toward a downstream end portion, sandwiched by a range shown by a hatched portion in part (a) of FIG. 7.

This slit 37*c* is a through hole from the first surface side to the second surface side similar to the air passing portion 37*c* in the guiding member 37 of FIG. 1 in the embodiment 1. Further, with respect to the longitudinal direction of the guiding member 37, as shown in the perspective view of part (b) of FIG. 7, the guiding member 37 is disposed so that a plurality of slits are successively provided. That is, as the air passing portion 37*c*, slit-like cut-away portions extending in the sheet feeding direction are successively disposed along the longitudinal direction.

The slits as the air passing portion 37*c* are open at a ratio of about 50% or more to an entire area of the first surface 37*a* similarly as the voids in the air passing portion 37*c* in the guiding member 37 of FIG. 1 in the embodiment 1.

Further, the duct 51 of the UFP duct unit 50 is disposed on the second surface 37*b* side of the guiding member 37, and the suction port 52 covered with the filter 53 of the duct 51 is disposed substantially opposed to the second surface 37*b* of the guiding member 37. Thus, the duct unit 50 is capable of suck, in the duct 51, the air which passed through the slits as the air passing portion 37*c* of the guiding member 37 by drive of the fan and which contains the UFP between the secondary transfer portion 17 and the fixing nip N, while filtering the air through the suction port 52.

Also in the case of this embodiment 2, a flow of the air passing through the filter 53 is caused to pass through this slits 37*a*, so that an effect of guiding the sheet S is similarly obtained without lowering the UFP collecting efficiency. Further, at the same time, an effect such that a scattering toner is not readily deposited on the filter 53 is also similarly obtained.

Embodiment 3

Figure 8:
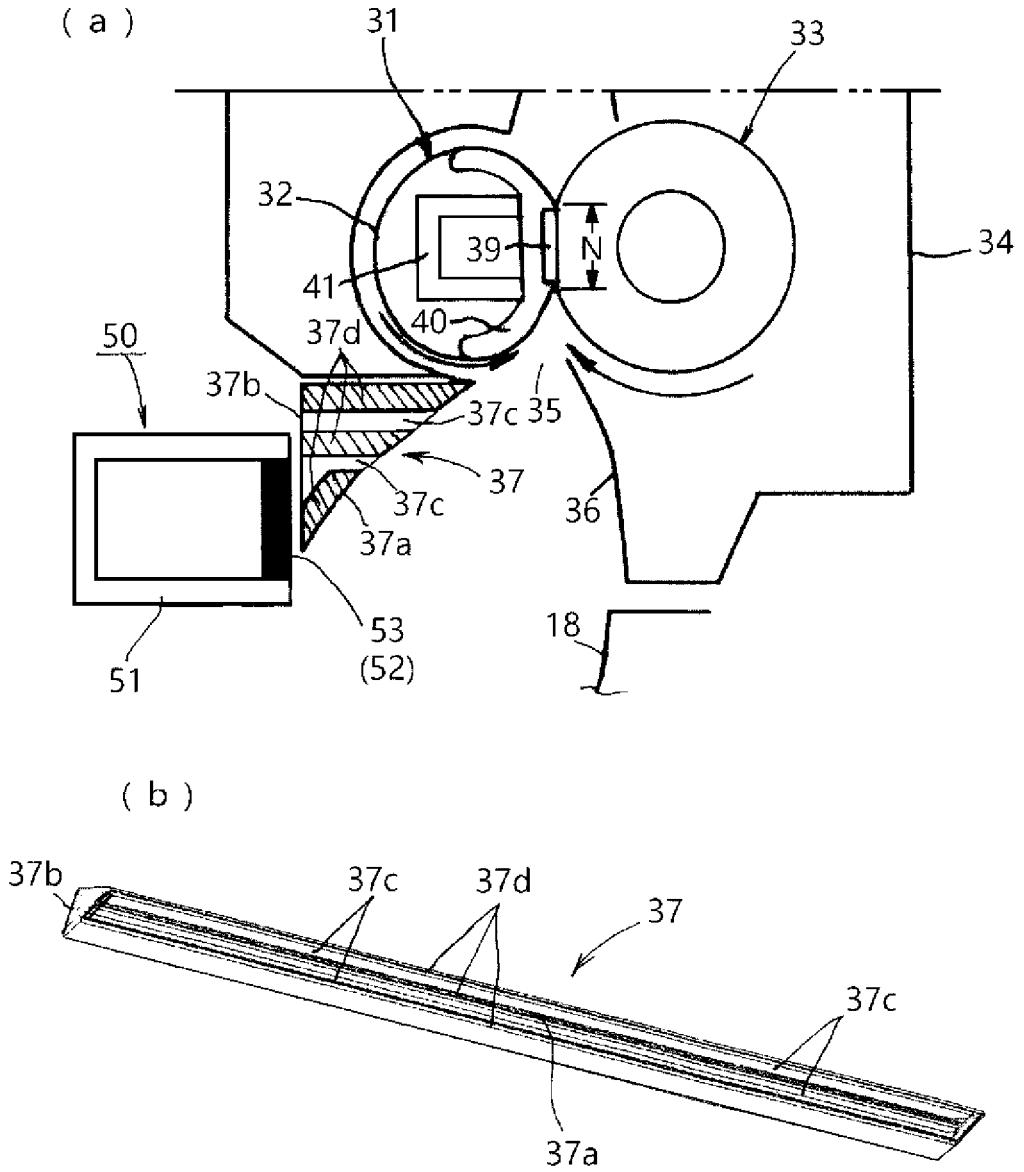
In FIG. 8, part (a) is an enlarged schematic cross-sectional view of a principal part of an image forming apparatus of an embodiment 3, and part (b) is a perspective view of a guiding member.

FIG. 8 includes illustrations of this embodiment 3, and part (a) is a schematic enlarged cross-sectional view of a principal part, and part (b) is a perspective view of an outer appearance of the guiding member 37. The guiding member 37 in this embodiment is also a mold product of a heat-resistant resin and is fixed integrally with a predetermined portion of the casing 34 of the fixing device 19. Further, the guiding member 37 has a first surface (a feeding surface for feeding the sheet) 37*a*. Further, the guiding member 37 has a second surface (rear surface) 37*b* on a side opposite from the first surface 37*a*. Further, the guiding member 37 is provided with an air passing portion (void) 37*c* functioning as an air passage for permitting air to flow from the first surface side to the second surface side.

The guiding member 37 in this embodiment 3 is constituted so that a plurality of guiding plates (guiding portions) 37*d* are laminated with respect to the sheet feeding direction. At this time, the guiding plates 37*d* are laminated with a predetermined angle with respect to the (sheet) feeding direction so that leading ends of the plurality of guiding plates 37*d* do not prevent feeding of the sheet S. This lamination of the plurality of guiding plates 37*d* is disposed with a predetermined unit as the air passing portion 37*c* with no hermetical contact.

That is, the guiding member 37 in this embodiment 3 is disposed along the longitudinal direction of the fixing nip N and includes the plurality of guiding portions 37*d* laminated with the predetermined angles with respect to the sheet feeding direction, and the air passing portion 37*c* is the plurality of voids each between the guiding portions.

The voids as the air passing portion 37*c* are open at a ratio of about 50% or more to an entire area of the first surface 37*a* similarly as the voids in the air passing portion 37*c* in the guiding member 37 of FIG. 1 in the embodiment 1.

Further, the duct 51 of the UFP duct unit 50 is disposed on the second surface 37*b* side of the guiding member 37, and the suction port 52 covered with the filter 53 of the duct 51 is disposed substantially opposed to the second surface 37*b* of the guiding member 37. Thus, the duct unit 50 is capable of sucking, in the duct 51, the air which has passed through the voids as the air passing portion 37*c* of the guiding member 37 by drive of the fan and which contains the UFP between the secondary transfer portion 17 and the fixing nip N, while filtering the air through the suction port 52.

Also in the case of this embodiment 3, a flow of the air passing through the filter 53 is caused to pass through these voids in the air passing portion 37*a*, so that an effect of guiding the sheet S is similarly obtained without lowering the UFP collecting efficiency. Further, at the same time, an effect such that a scattering toner is not readily deposited on the filter 53 is also similarly obtained.

As described above in detail, it is understood that the UFP reducing means with a low cost, a small size and high efficiency can be provided with no influence on the sheet feeding property and the filter performance.

1) In the above, the embodiments to which the present invention is applicable were described, but the present invention is not limited to such embodiments. For example, as the fixing device, a fixing device of a heating roller type and a fixing device of a type utilizing electromagnetic induction heating may be used.

2) The suction port 52 may also be provided on the pressing roller 33 side with respect to the sheet feeding path, and the guiding member 36 may be provided with the air passing portion. That is, in this case, different from the above-described embodiments, even when the feeding state of the sheet S is normal, the guiding member 36 contacts the (back surface of) sheet S. Also, in such an example, in this embodiment, the guiding member 36 is called the "guiding portion". Further, the suction port 52 may also be provided on both the belt 32 side and the pressing roller 33 side. In this case, the air passing portion is provided on the guiding member 37 side and on the guiding member 36 side. The fan F may be a cross-flow fan or a blower fan.

3) The sheet feeding path is not limited to a vertical path structure, but may also be a horizontal path type or a type in which the sheet is fed obliquely.

4) In the embodiment, as the image forming apparatus 100, a multi-function printer including a plurality of the drums 2 was described. However, to a monochromatic multi-function printer or single function printer, which includes a single drum 2, the present invention is also applicable. Accordingly, the image forming apparatus according to the present invention is not limited to the multi-function printer.

INDUSTRIAL APPLICABILITY

According to the present invention, there is provided an image forming apparatus high in collecting efficiency.

The invention claimed is:

1. An image forming apparatus comprising:

an image forming portion configured to form a toner image on a sheet at a first position by using toner containing a parting agent;

a fixing portion configured to fix an unfixed toner image formed on the sheet at a second position;

a duct, including a suction port provided between the first position and the second position with respect to a sheet feeding direction, and configured to discharge air sucked through said suction port to an outside of said image forming apparatus;

a filter, provided in the suction port of said duct, configured to collect particles of a predetermined particle size resulting from the parting agent; and a guiding portion, provided between the first position and the second position with respect to the sheet feeding direction and between said filter and a sheet feeding path with respect to a thickness direction of the sheet passing through the second position, and configured to guide the sheet from the first position to the second position, wherein said guiding portion is provided with an air passage for permitting air to flow from the sheet feeding path toward said suction port.

2. An image forming apparatus according to claim 1, wherein said guiding portion is provided with a through-hole as said air passage.

3. An image forming apparatus according to claim 1, wherein said guiding portion is disposed at a position opposing the unfixed toner image formed on the sheet.

4. An image forming apparatus according to claim 1 wherein the second position is above the first position with respect to a direction of gravitation.

5. An image forming apparatus according to claim 1, wherein the parting agent is a wax, and the predetermined particle size is 5.6 nm or more and 560 nm or less.

6. An image forming apparatus according to claim 1, further comprising a fan configured to form an air flow in said duct.

7. An image forming apparatus according to claim 1, wherein an upstream side end of said guiding portion with respect to the sheet feeding direction is closer to the second position with respect to the thickness direction of the sheet passing through the second position than a downstream side end of the guiding portion is.

8. An image forming apparatus according to claim 7, wherein said guiding portion includes a guide surface inclined from the upstream side end to the downstream side end.

9. An image forming apparatus according to claim 1, wherein said fixing portion includes a first rotatable member, a second rotatable member forming a nip portion for nipping and feeding the sheet with said first rotatable member, and a casing accommodating said first rotatable member and said second rotatable member, and wherein said guiding portion is integrally fixed with said casing.

10. An image forming apparatus according to claim 9, further comprising a door configured to open an upstream side feeding path with respect to the sheet feeding direction to said fixing portion by being opened, and wherein said guiding portion is capable of being taken out integrally with said fixing portion in a state in which said door is opened.

* * * * *